US005389407A

United States Patent [19]

Sokol

[11] Patent Number: 5,389,407

[45] Date of Patent: Feb. 14, 1995

[54] THERMAL SPRAYING COATING METHOD

[75] Inventor: Larry Sokol, Delray Beach, Fla.

[73] Assignee: Sermatech International, Inc., Limerick, Pa.

[21] Appl. No.: 969,528

[22] Filed: Oct. 30, 1992

Related U.S. Application Data

[63] Continuation of Ser. No. 806,848, Dec. 9, 1991, abandoned, which is a continuation of Ser. No. 617,001, Nov. 21, 1990, abandoned.

[51] Int. Cl.[6] ..... B05D 3/06

[52] U.S. Cl. ..... 427/450; 427/249; 427/250; 427/255.2; 427/422; 427/427; 427/451; 427/455; 427/456; 427/576; 427/577

[58] Field of Search ..... 427/450, 451, 455, 456, 427/249, 250, 255.2, 422, 427, 576, 577

[56] References Cited

U.S. PATENT DOCUMENTS 4,741,286 5/1988 Itoh et al. ..... 427/34 X
4,853,250 8/1989 Boulos et al. ..... 427/34
4,982,067 1/1991 Marantz et al. ..... 427/34 X

FOREIGN PATENT DOCUMENTS 0148665 7/1985 European Pat. Off. .
2008357 3/1990 Japan .
2025558 4/1990 Japan .

OTHER PUBLICATIONS

Kayser, H., "Spraying Under an Argon Atmosphere", Thin Solid Films, vol. 39, pp. 243–250, 1976 (no month available).

*Primary Examiner*—Bernard Pianalto
*Attorney, Agent, or Firm*—Reising, Ethington, Barnard, Perry & Milton

[57] ABSTRACT

An apparatus (10) for applying a thermal spray coating onto a substrate (24) includes a chamber (16) having an open bottom portion (18), a gas source for releasing a gas lighter than oxygen into the chamber (16) and displacing the oxygen from the chamber (16), and a spray gun (30) for spraying coating through the gas in the chamber (16) and onto the substrate (24).

A method is also provided including the steps of displacing oxygen from the chamber (16) with the gas, and spraying the coating through the gas and onto the substrate (24) disposed within the chamber, the gas preventing oxidation between the substrate (24) and layers of the coating.

9 Claims, 3 Drawing Sheets

THERMAL SPRAYING COATING METHOD

This is a continuation of application(s) Ser. No. 07/806,848, filed on Dec. 9, 1991, now abandoned which is a continuation of Ser. No. 617,001, filed on Nov. 21, 1990, now abandoned.

TECHNICAL FIELD

The present invention relates to the coating arts and more particularly, the production of coatings by thermal spray techniques, such as plasma spray methods.

BACKGROUND OF THE INVENTIONS

Thermal spraying techniques have been used to apply durable coatings to metallic substrates. A wide variety of metallic alloys and ceramic compositions have been used in accordance with these prior art techniques.

The prior art thermal spray processes involve the generation of a high temperature carrier medium into which powders of the coating material are injected. With specific regard to plasma coating techniques, a plasma powder gun or a plasma wire gun is used in a controlled atmosphere to apply the coating to the substrate. The U.S. Pat. No. 4,235,943 to McComas et al, issued Nov. 25, 1980, and U.S. Pat. No. 4,256,779, to Sokol et al, issued Mar. 17, 1981, both patents being assigned the assignee of the present invention, relate to plasma spray methods and apparatus of the above described type. Such plasma spray coating guns as disclosed in these prior art patents utilize an inert gas, helium, as the plasma and carrier gas.

It is desirable in plasma spray methods to spray powders which are highly reactive. Specifically, the MCrAly family of coatings such as nickel, cobalt, chromium-aluminum ytrium alloys or cobalt nickel chromium-aluminum ytrium alloys can be used in which case oxygen caught within the coatings is a very critical factor to control. It is necessary to keep oxygen content in the spraying environment as low as possible. It is therefore a goal of the present invention to markedly reduce the oxide content of parts sprayed within the spraying environment by reducing oxides in the coating which tend to be detrimental.

Previously, low pressure plasma chambers have been used for plasma spraying in which the chamber is pumped down to a near vacuum and the parts are coated using a plasma gun process inside the chamber. These systems are very expensive, requiring large chambers for containing large parts which must be able to withstand the internal vacuum. Further, these chambers require mechanical pumps to create the vacuum within the chamber. These pumps contribute to the great expense of the use of the already expensive chambers.

The present invention provides a controlled atmosphere chamber which can markedly reduce the oxide content of parts sprayed thereby allowing the use of more reactive, very oxidation prone powders but not requiring the expense of using of a vacuum in the expense associated therewith.

SUMMARY OF THE INVENTION

In accordance with the present invention, there is provided a method of applying a thermal spray coating, the method including the steps of disposing a substrate in a chamber containing oxygen, displacing the oxygen from the chamber with a gas which is inert to the substrate, the chamber, and the thermal spray coating, and spraying the coating through the gas and onto the substrate. The gas prevents oxidation between the substrate and the layers of the coating.

The present invention further provides an apparatus for applying a plasma spray coating onto the substrate, the apparatus including the chamber having an open bottom portion for exhausting a gas therefrom and a gas source for releasing a gas lighter than oxygen into the chamber and displacing the oxygen from the chamber. Spraying means sprays the coating through the gas in the chamber and onto the substrate. The chamber contains the gas about the spraying means and the substrate.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
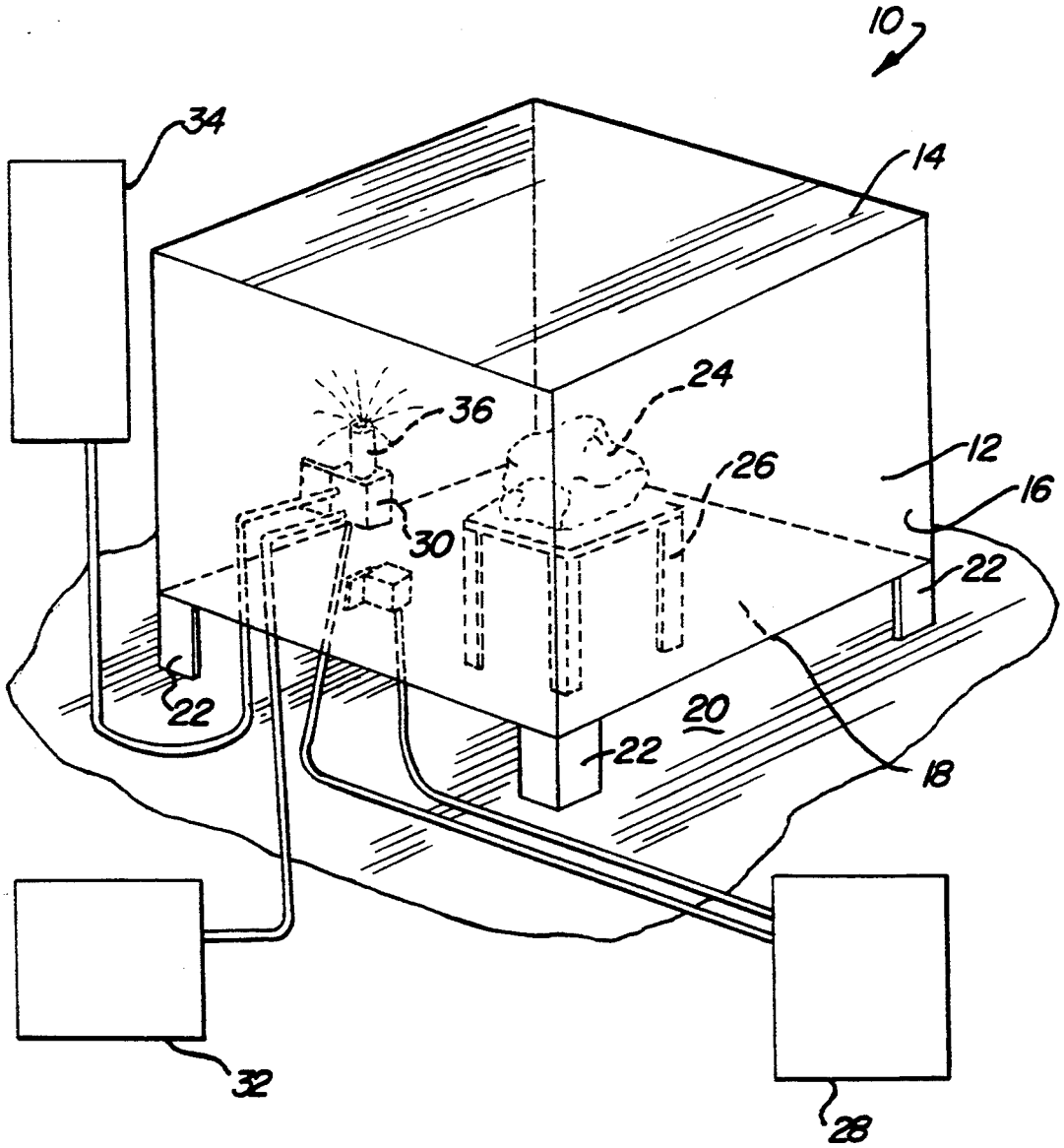
FIG. 1 is a perspective view, schematically shown, of an apparatus constructed in accordance with the present invention.

An apparatus for applying a thermal spray coating is generally shown at 10 in the Figure. The apparatus 10 includes four side walls 12 and a top wall 14 defining a chamber 16 therewithin. The chamber 16 includes an open bottom portion 18 for exhausting a gas therefrom as described below. The housing can have various means for elevating it from a floor 20, such as legs 22. Within the chamber can be various means for supporting a substrate 24 the substrate support being schematically shown at 26.

The walls of the housing can be made from a thin metallic material, such as sheet metal, that could withstand the temperature of the operation. However, the chamber need not be made from heavy materials such as those used in prior art low pressure plasma chambers since the present invention does not require a vacuum within the chamber. To the contrary, the chamber is merely a housing type structure, shown in the drawings as a box like structure but not necessarily having to be so, having an open bottom. Further, the bottom need not be open completely but can be in the form of an exhaust port or the like.

Generally, the apparatus 10 includes a gas source for releasing a gas lighter than oxygen into the chamber 16 and displacing oxygen from the chamber 16. As shown in FIG. 1, the gas source can be an independent source of gas 28 which can run directly into the chamber 16 or the source of gas can be led to the spray gun 30 as described below. In either embodiment, the gas source 28 would contain a gas which is inert to the chamber 16, the substrate 24, and the coating so as to not react with either. The gas displaces the oxygen in the chamber creating a low oxygen environment in which the part or substrate 24 can be coated to prevent oxidation between the substrate and between the coating layers which is inherently a major problem of all plasmas for a coating.

The spraying means shown in FIG. 1 could be a plasma powder gun or plasma wire gun or the like for spraying the coating through the gas in the chamber and onto the substrate 24, the chamber 16 containing the gas about the spray gun 30 and substrate 24 and therebetween.

More specifically, the spray gun 30 can be of the type disclosed in the aforementioned U.S. Pat. Nos. 4,235,943 and 4,256,779. The spray gun 30 would be operatively connected to the source of gas 28, a source of plasma 32, and a power source 34 operatively connected to the electrodes of the spray gun 30. Such a machine could be the Metco Type K Heavy Duty Metallizing Machine and Type C Automatic Control System, manufactured by Metco, Inc., Westbury, N.Y. A second example is the High Performance Metco 7M Plasma Process, also manufactured by Metco, Inc. of Westbury, N.Y. These systems generally include a spray gun, various extensions, power feeders, control consoles, and cooling power equipment not specifically shown in FIG. 1. Additionally, the subject invention can be used with the GATOR-GARD coating process for applying GATOR-GARD coatings. This process utilizes a high temperature, high velocity, ionized gas to deposit metal or ceramic particles on substrate materials wherein the high particle velocities and their extremely short dwell time at high temperature produces dense, well bonded coatings with unique structures which can be tailored for resistance to wear, erosion, and impact.

As stated above, the gas source 28 can be directly fed into the chamber 16 or can be operatively connected to the spray gun 30, as shown in FIG. 1, such that the spray gun exhausts the gas into the chamber 16 and thereby defines the gas source of the invention. That is, the spray gun itself can use the inert gas, such as helium in the GATOR-GARD process, as the shrouding gas for the spray gun, the shrouding gas displacing oxygen within the chamber 16. Of course, the two types of gas sources can be combined such that the gas source is connected to the spray gun and uses the shrouding gas (and possibly the plasma gas) as well as having an independent lead into the chamber 16. Thusly, inert gas is used as the carrier gas, the plasma gas, and is also independently fed into the chamber 16.

As shown in FIG. 1, preferably the spray gun 30 includes the nozzle portion 36 directed towards the top portion 14 of the housing for directing the plasma spray in a vertically upwardly direction into the top portion of the chamber 16, although applicant has found that mounting the nozzle portion in a horizontal direction also effectively works in accordance with the present invention. When the exhaust gas from the spray gun 30 is also the gas displacing the oxygen in the chamber 16, this is an efficient orientation for directing the shrouding gas upwardly to displace oxygen downwardly in the chamber 16.

Besides using helium as described above, other inert gases can be used which are inert to the substrate 24, chamber 16 and coatings that are used. By inert, it is meant that the gases do not react with the substrate 24, chamber 16, and coatings. Accordingly, gases that may be otherwise reactive, such as nitrogen, but which are inert in the inventive system, can be used with the present invention. That is, the gases used with the present invention are not limited to the family of nobel gases. For example, other typical inert gases as well as gases such as hydrogen and nitrogen can be used. These gases allow the use of the MCrAly family of coatings described above.

In certain situations it may be necessary to heat the gas from the gas source. Alternatively, the chamber 16 itself can be kept at various temperatures. Most likely, the chamber 16 would be heated by the plasma process to some equilibrium temperature between 250° and 500° F., most likely between 400° and 500° F.

Applicant has also used the present invention with other materials such as tungsten carbides.

Applicant has determined that the reduced density of helium gas in the chamber 16 allows a greater standoff (distance between the gun 30 and substrate 24) for the gun 30 to work. This increased distance between the gun 30 and the substrate 24 enables areas to be coated which were inaccessible utilizing prior art technologies. Applicant has been able to increase the standoff distance by approximately 25% which brings a whole new class of substrates into coating range, substrates that were not previously coatable utilizing other prior art methods.

It is further possible to use the present inventive process in combination with plasma spray processes in which helium or possibly helium and other inert gas mixtures are passing through either the spray gun 30 or directly into the chamber.

The present invention can be used with all of the coatings that are presently used for plasma spraying, such as all of the powder metal powders that have been designed by manufactures to be used for air spray applications; that is, for spraying into an air environment. This solves a problem where particular alloys have been previously chosen to be sprayed in air and if they were oxidation prone, the particle size was made larger reducing surface areas so that the material could be sprayed. There are also certain materials that are not easily sprayed in air, one of the materials being the MCrAly coatings described above. These coatings are sprayed primarily in the low pressure plasma chambers. The controlled atmosphere of the present invention obviates the need for the low pressure plasma chamber and allows other powders which previously could not be sprayed or needed to be sprayed as larger size particles to be sprayed. Further, the present invention allows the addition of other powders which could be applied such as very reactive, very oxidation prone powders, powders of smaller particle size and larger surface areas presently being used. These would be materials such titanium, titanium alloys, and perhaps magnesium, magnesium alloys, and some aluminum alloys which are presently sprayed in relatively course particle sizes in order to keep the surface area low and eliminate massive oxidation.

The present invention further provides a method of applying a thermal spray coating generally including the steps of disposing the substrate 24 in the chamber 16 initially containing oxygen, displacing the oxygen from the chamber 16 with gas which is inert to the substrate 24, chamber 16, and a thermal spray coating being applied, and spraying the coating through the gas and onto the substrate 24, the gas preventing oxidation between the substrate 24 and the layers of the coating.

More specifically, the gas chosen would be lighter than oxygen, as well as inert as described above, and the chamber 16 would have the open bottom 18 as described before. The method would then more specifically include the step of filling the chamber 16 with the gas while forcing the oxygen through the open bottom 18 of the chamber 16.

The following examples illustrate the benefits of the present invention. More specifically, Example 1 provides experimental data showing that the chamber made and used in accordance with the present invention allows an increase in spray distance without loss of coating hardness for tungsten carbide, cobalt coatings. Example 2 shows the reduction of oxides achieved with a MCrAly coating sprayed with identical parameters when the chamber is utilized. By reducing oxide content of the deposited coating layers, it is believed that the coating is prevented from cracking and separating between layers.

EXAMPLE 1

It is desired to spray a powder consisting of 88 wt % WC and 12 wt % cobalt onto a titanium substrate using the GATOR-GARD process to form a dense well bonded coating. On typical use for this coating is to hardface the midspan shrouds of gas turbine engine blades to prevent wear and premature failure. A critical property of the coating is the microhardness. A value of 950 DPH using a 300 gram load is the minimum accepted hardness fore this particular coating. Coating hardness decreases as the substrate being coated is moved furether away from the spray gun. Because of this limitation it has not been possible previously to coat certain designs of fan blades because the blade configuration would not allow the spray gun to be positioned close enough to surface being coated to achieve the necessary minimum microhardness.

Two tests were run. In Test A, test samples were sprayed in the normal manner without the chamber at various distances. In test B, the identical procedure and coating paramenters were used but the coating was performed within the chamber. The following results were obtained:

| Spray Distance | Microhardness TEST A (Air) | Microhardness TEST B (Chamber) |
|---|---|---|
| 2" | 1007 | 1027 |
| 2-½" | 979 | 1055 |
| 3" | 928 | 983 |
| 4" | 894 | 975 |
| 4-½" | 836 | 987 |

These data clearly illustrate the effectiveness of the chamber in increasing the coating microhardness at all spray distances. Using the chamber it is possible to achieve the required hardness at distances as great as 4½" whereas the standard coating procedure failed to meet the minimum hardness requirement at a distance of 3".

EXAMPLE 2

To achieve maximum effectiveness, The MCrAlY family of coatings must be deposited with an absolute minimum amount of contamination by oxygen. A NiCoCrAlY powder with a nominal composition of 22Co-17Cr-12.5Al-0.25Hf-0.45Si-0.6Y-Bal Nickel was sprayed onto 0.5" diameter round bars of Inconel 718 alloy using the GATOR-GARD process. Two sets of parts were sprayed. Set A was coated in the chamber while Set B was coated without the chamber. All other coating parameters and conditions were identical. Following coating, all samples in Set A and Set B received a diffusion heat treatment in vacuum for 4 hours at 1975° F.

Figure 2:
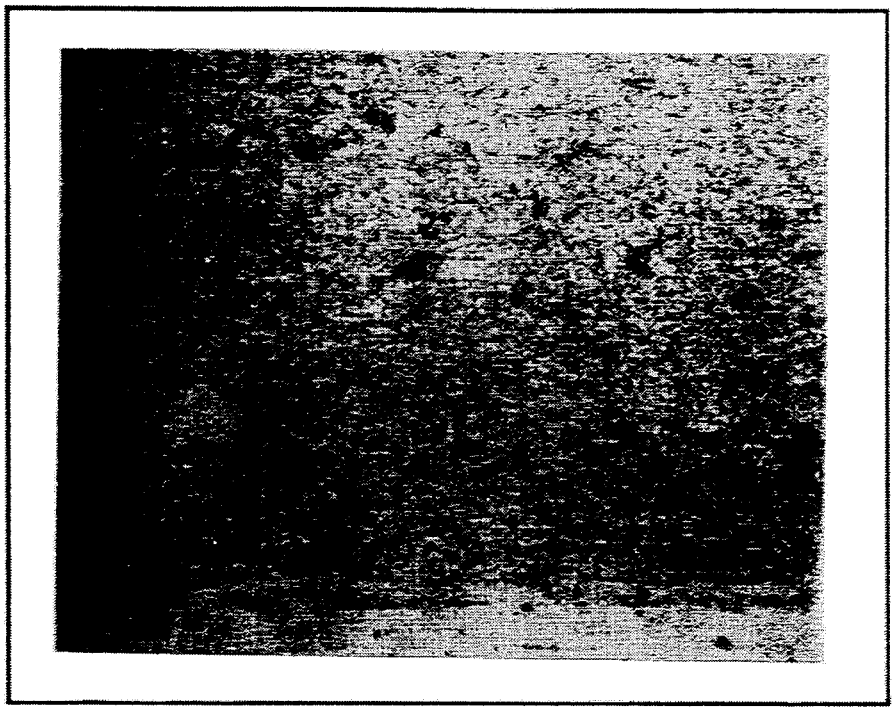
FIGS. 2, 3, 4, and 5 are photographs of test parts that were sectioned, mounted, polished and metallographically examined pursuant to the procedure set forth in Example 2 hereafter.
Figure 3:
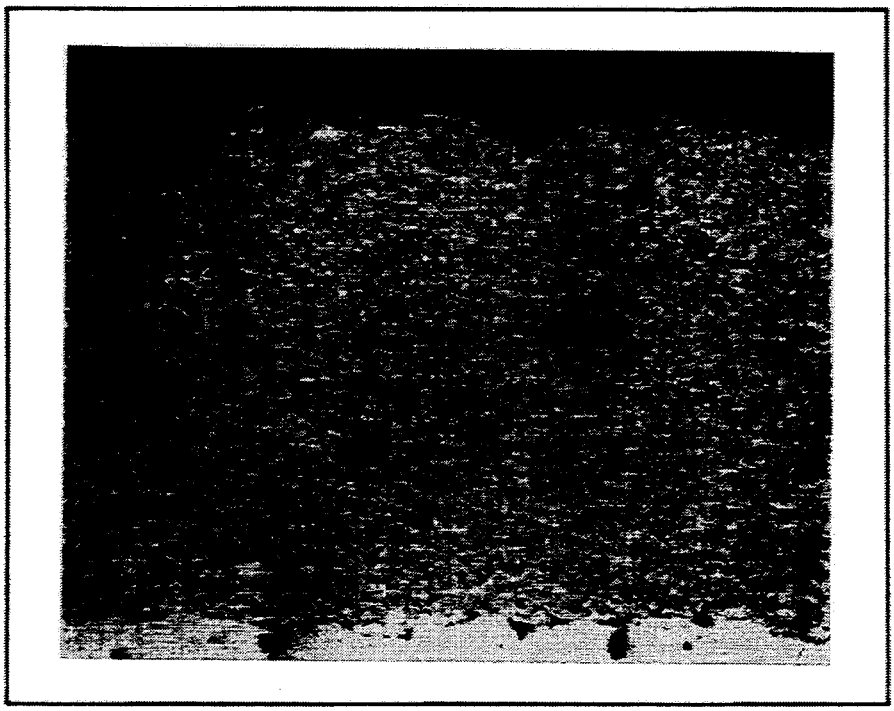
Figure 4:
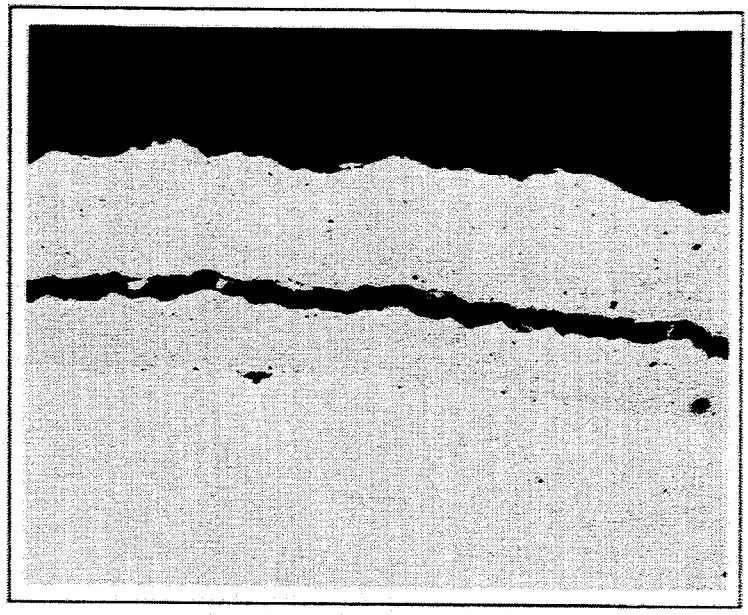
Figure 5:
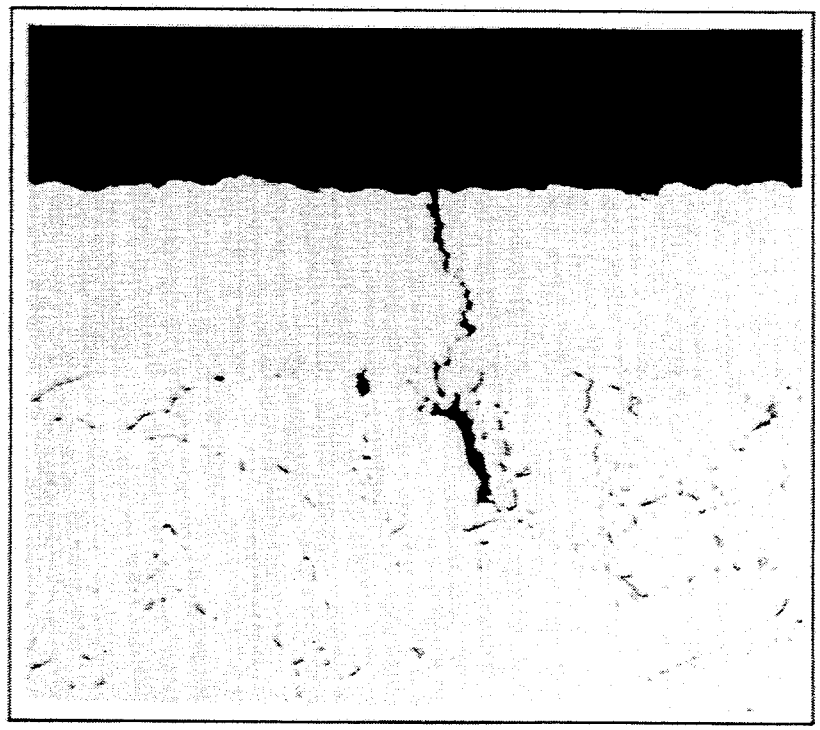

Parts from Set A and Set B were sectioned, mounted, polished and mewtallographically examined. Set A parts had a dense, oxide free structure and were free of cracks. An example of the Set A microsctructure is shown in FIG. 2. Set B parts showed fine layers of oxides within the coating, separation between layers of coating and vertical cracks from the coating surface to and even into the substrate. Examples of these defects are shown in FIGS. 3, 4 and 5 respectively. FIG. 3 shows the NiCoCrAlY coating magnified 357×. FIG. 4 shows the NiCoCrAlY coating magnified 500×. FIG. 5 shows the NiCoCrAlY coating sprayed in air showing a crack into the substrate, magnified 200×.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A method of applying a thermal spray coating, said method including the steps of:

disposing a substrate (24) in a chamber (16) having an opening that is continuously open to ambient atmosphere about said chamber and said chamber initially containing oxygen, substantially filling the chamber (16) with a gas which displaces oxygen from the chamber (16) through the opening to ambient, the gas being inert to the substrate (24), the chamber (16), and thermal spray coating material; thermally spraying thermal spray coating material through the gas and onto the substrate (24) to form the thermal spray coating; the gas preventing oxidation between the substrate (24) and the thermal spray coating, and continuously supplying the chamber with the inert gas simultaneously with the spraying of the thermal spray coating material through the gas and onto the substrate.

2. A method as set forth in claim 1 wherein the gas is lighter than oxygen and the chamber (16) has an open bottom (18), said method further including the steps of filling the chamber (16) with the gas while forcing the oxygen out through the bottom (18) of the chamber (16).

3. A method as set forth in claim 2 wherein said filling step is further defined as filling the chamber (16) with the gas from a source (28) which is independent of a gun (30) used for spraying the substrate (24).

4. A method as set forth in claim 2 wherein the thermal spray coating is a plasma coating applied by a gun (30) using the gas as a plasma gas and carrier gas, said filling step being further defined as exhausting the gas from the gun (30) and filling the chamber (16) with the exhausted gas, the chamber (16) trapping the exhausted gas as the oxygen is displaced therefrom through the open bottom (18) of the chamber (16).

5. A method as set forth in claim 2 wherein the chamber (16) includes an open bottom (18) and the thermal spray coating is a plasma coating is applied by a gun (30) using the gas as the plasma gas and carrier gas, said spraying step being further defined as spraying a gas as an exhaust gas from the gun (30) vertically into the top area of the chamber (16) to assist in displacing oxygen therefrom and forcing the oxygen out of the bottom (18) of the chamber (16).

6. A method as set forth in claim 1 wherein said spraying step is further defined as spraying a coating containing nickel, cobalt, chromium-aluminum ytrium alloys, and tungsten carbides.

7. A method as set forth in claim 1 further including the step of heating the gas to about 250° to 500° F.

8. A method as set forth in claim 1 wherein the gas is selected from the group of inert gases.

9. A method as set forth in claim 1 wherein the gas is hydrogen.

* * * * *